US006126109A

United States Patent [19]

Barson et al.

[11] Patent Number: 6,126,109

[45] Date of Patent: Oct. 3, 2000

[54] UNLOCKING TAIL FIN ASSEMBLY FOR GUIDED PROJECTILES

[75] Inventors: George F. Barson, Plano; Richard M. Weber, Prosper, both of Tex.

[73] Assignee: Raytheon Company, Lexington, Mass.

[21] Appl. No.: 09/016,233

[22] Filed: Jan. 30, 1998

Related U.S. Application Data

[60] Provisional application No. 60/043,894, Apr. 11, 1997.

[51] Int. Cl.[7] ..... F42B 10/54; F42B 10/14; F42B 13/32; F42B 13/20

[52] U.S. Cl. ..... 244/3.28

[58] Field of Search ..... 244/3.28, 3.24, 244/3.26, 3.27, 3.29, 3.3

[56] References Cited

U.S. PATENT DOCUMENTS

| | | | |
|---|---|---|---|
| 2,044,819 | 6/1936 | Taylor | 102/388 |
| 2,402,718 | 6/1946 | Albrea | 244/3.1 |
| 2,611,317 | 9/1952 | Africano | 244/3.24 |
| 4,024,998 | 5/1977 | Rabinow et al. | 244/3.26 |
| 4,076,187 | 2/1978 | Metz . | |
| 4,373,688 | 2/1983 | Topliffe | 244/3.24 |
| 4,520,972 | 6/1985 | Diesinger et al. . | |
| 4,546,940 | 10/1985 | Andersson et al. . | |
| 4,552,071 | 11/1985 | Horais et al. | 244/3.28 |
| 4,565,340 | 1/1986 | Bains | 244/3.28 |
| 4,600,167 | 7/1986 | Kastenhuber et al. | 244/3.28 |
| 4,664,339 | 5/1987 | Crossfield | 244/3.28 |
| 5,108,051 | 4/1992 | Montet et al. | 244/3.28 |
| 5,186,413 | 2/1993 | Deakin | 244/3.28 |
| 5,326,049 | 7/1994 | Rom et al. | 244/3.28 |
| 5,464,173 | 11/1995 | Sharrow et al. | 244/3.28 |
| 5,820,072 | 11/1998 | Na et al. | 244/3.28 |

FOREIGN PATENT DOCUMENTS

| | | | |
|---|---|---|---|
| 0066715A2 | 12/1982 | European Pat. Off. . | |
| 294657 | 3/1932 | Italy | 244/3.3 |
| 1188951 | 4/1970 | United Kingdom . | |

*Primary Examiner*—Charles T. Jordan
*Assistant Examiner*—Denise Buckley
*Attorney, Agent, or Firm*—Baker Botts L.L.P.

[57] ABSTRACT

A tail fin assembly for a guided projectile which is capable of withstanding the high pressures experienced during launch, which is also capable of stabilizing the projectile during initial flight shortly after emergence from the cannon or large gun barrel and which is also capable of freely spinning relative to the projectile front section for the remainder of the flight to minimize projectile roll to accomplish all of these capabilities sequentially during a single launch. The assembly includes the projectile and a rotatable member, preferably a tail fin assembly with tail fins which is rotatable about the projectile major axis and which is normally locked against rotation about the projectile. A locking structure is provided for locking the rotatable member against the rotation which is responsive to a predetermined condition to permit rotation of the rotatable member about the projectile. The tail fins are normally retracted and secured to the rotatable member and are extendable in response to a predetermined condition.

24 Claims, 2 Drawing Sheets

UNLOCKING TAIL FIN ASSEMBLY FOR GUIDED PROJECTILES

CROSS REFERENCE TO RELATED APPLICATION

This application claims priority under 35U.S.C §119 of provisional application No. 60/043,894 filed Apr. 11, 1997.

TECHNICAL FIELD OF THE INVENTION

This invention relates to an assembly for guided projectiles which can withstand high pressures experienced during launch, which is capable of stabilizing the projectile during launch and which is capable of freely spinning relative to the projectile for the remainder of the flight and, more specifically to a tail fin assembly for such guided projectiles.

BACKGROUND OF THE INVENTION

Guided projectiles are generally launched from the barrel of a launching apparatus, such as, for example, a cannon or a large gun. During the launch sequence, the aft section of the projectile can experience very high pressures. Once the projectile is launched and has exited the barrel of the launching apparatus, it is generally spinning. It is desirable to roll stabilize the projectile rapidly after exit from the barrel in order that the guidance system and particularly the operation of the guidance system in conjunction with the global positioning system (GPS) be used to its fullest potential. This requires that the spin be rapidly arrested, at least with reference to the projectile antenna, which is generally in the front portion of the projectile. Once the projectile is stabilized and no longer spinning, it is then desirable that the tail fin assembly spin relative to the body of the projectile to minimize roll of the projectile during its continued flight so that contact with the GPS system can be maximized during this period.

There is no known prior art which is capable of accomplishing the above stated functions. It follows that a mechanism capable of performing each of the above described operations on a launched projectile in the sequence described is highly desirable.

SUMMARY OF THE INVENTION

In accordance with the present invention, there is provided an assembly and, more specifically, a tail fin assembly for a guided projectile which is capable of withstanding the high pressures experienced during launch, which is also capable of stabilizing the projectile during initial flight shortly after emergence from the cannon or large gun barrel and which is also capable of freely spinning relative to the projectile front section for the remainder of the flight to minimize projectile roll to accomplish all of these capabilities sequentially during a single launch.

Briefly, the above is accomplished by providing a tail fin assembly having retracted, projectable tail fins which is secured to the aft section of the projectile and remains in that state during launch. A releasing mechanism is triggered by the initial propulsion of the projectile so that, after a predetermined time delay which permits the projectile to first exit the gun barrel, the tail fin assembly is unlocked from the remainder of the projectile and permitted to rotate around the projectile major axis. The releasing mechanism is preferably an expellable igniter release bearing which passes through the tail fin assembly and into the exhaust nozzle assembly and which is ejected from the system after ignition. Ignition is preferably responsive to and has a predetermined delay after projectile fining. The tail fins are secured to the tail fin assembly and are projected outwardly shortly after the projectile exits the gun barrel. Projection of the tail fins can be by any standard mechanism, such as, for example, by passing the propellant gas over the tail fins to force their outward projection or by providing a bias on the tail fins with the tail fins being retained in the retracted state. The tail fin assembly now rotates due to the drag on the tail fins. The tail fin assembly is preferably disposed on ball bearings disposed in a race between the tail fin assembly and the exhaust nozzle assembly at the aft portion of the projectile.

In operation, the projectile is placed in a gun or cannon barrel and is projected outwardly from the barrel by ignition of propellant. The projectile will have some spin upon ejection from the barrel, this spin being retarded by the projection of the tail fins out of the tail fin assembly to counteract the initial spin. After a short time delay, the tail assembly to which the tail fins are attached is unlocked from the rest of the projectile and commences spinning. The spinning of the tail fin assembly minimizes further roll of the projectile during flight and maximizes contact of the flight control system in the projectile with the GPS and any other source of signals directed to the projectile.

By controlling roll with the tail fin assembly, the front fins or canards can be used for their standard operation as projectile wings and not to control roll. In this manner, due to the minimal drag on the front fins, the range of the projectile for a given amount of propellant is maximized.

A unique feature of the aft motor closure of the present invention is the incorporation of a free-to-roll boat tail, to which four fins (only two of which are shown in FIG. 1) are attached. This feature facilitates despinning of the projectile following launch to aid in acquisition of GPS and other signals. In operation, a bearing assembly is locked to the air-frame until preferably 2.5 seconds after exiting the gun. At this time, the bearing assembly unlocks, allowing the boat tail fin assembly to free-roll. Operation of the bearing assembly is shown with reference to FIGS. 2 and 3 which show aft closure cross sections. FIG. 2 shows the bearing assembly in the locked position. When locked, the boat tail (with four fins attached) is held tightly against the rear of the motor closure plate. Tight contact is required to properly preload seals used to stop gun gases from entering the plane of contact between the boat tail and motor closure plate. This insures that gun gases contacting the remainder of the boat tail surface result in a force that pushes the boat tail into the motor closure plate as the projectile travels through the barrel.

To hold the boat tail in place, two bearing locking igniters are used as locking pins. When the gun is fired, gun pressure activates the two bearing locking igniters in the same manner as the motor igniter is initiated, except that the delay pyrotechnic train is designed for a 2.5 second delay. After 2.5 seconds, the bearing locking igniters blow out and unlock the boat tail. Once unlocked, the boat tail slides back on the elongated bearing races, resulting from the drag forces, creating a running gap that eliminates any possible friction caused by the seals, as shown in FIG. 3. With the boat tail unlocked after 2.5 seconds, the boat tail is free to roll and is roll decoupled from the airframe.

DETAILED DESCRIPTION OF THE INVENTION

Figure 1:
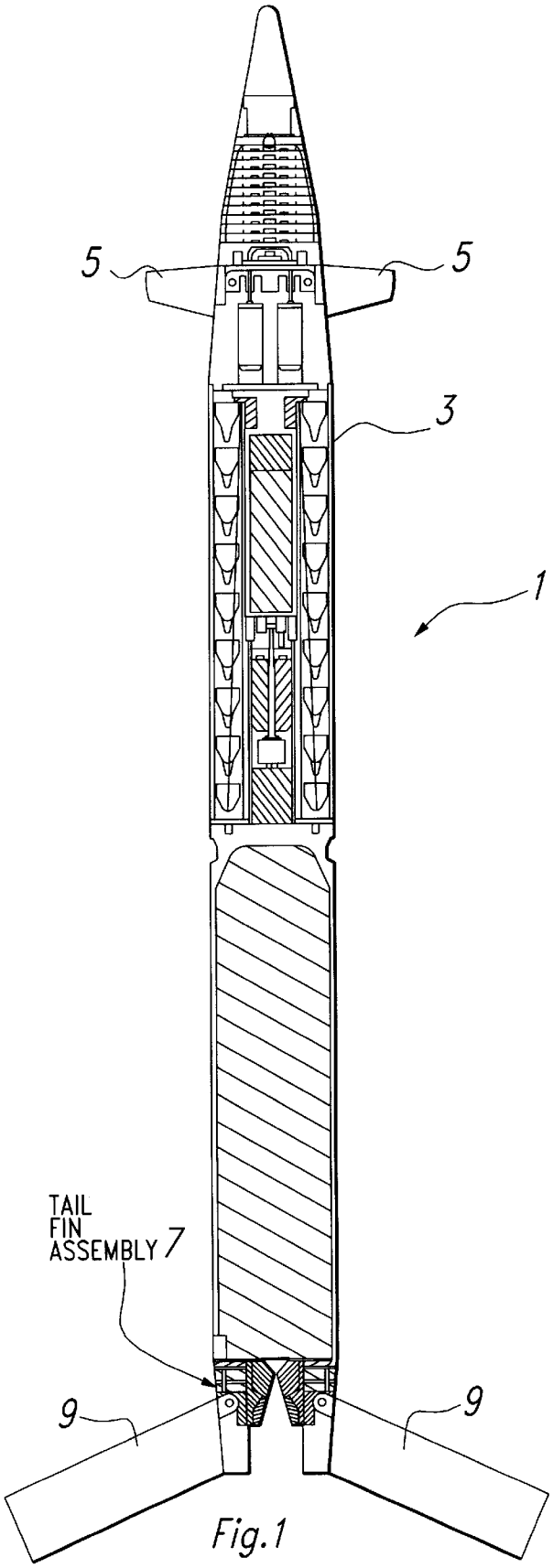
FIG. 1 is side view of a typical guided projectile which can use the tail fin assembly in accordance with the present invention.

Referring first to FIG. 1, there is shown a typical guided projectile 1 having forward section 3 having a set of motor driven front fins or canards 5 which can be used for projectile roll stabilization and are preferably used mainly to provide the normal lift and control operation of aircraft wings. The front fins are initially retracted and are projected out of the projectile after ejection of the projectile from the cannon or large gun barrel. The projectile also includes a tail fin assembly 7 having tail fins 9 in the aft section, the operation of which will provide the desirable results enumerated above which will be discussed in more detail hereinbelow. The tail fin assembly 7 and the combination of its operation with the remainder of the projectile are the subject of the present invention.

While the front fins or canards 5 can theoretically inhibit rolling of the projectile after the initial roll has been stopped or sufficiently minimized, in practice this is not practical. Movement of the canards 5 to prevent roll also removes kinetic energy from the system and results in a diminished range to the projectile whose maximum range is fixed by the amount of fuel initially on board. Maximum range is provided when the canards 5 have minimum contact with the atmosphere to provide minimum drag. It is therefore important that tail fin induced roll be prevented in some other manner since maximum range is an essential requirement of the projectile. The tail fins 9 can provide this function except that there is a problem in that the tail fins cannot be fabricated and installed with the precision required to prevent spin due to the inherent asymmetry and imperfections therein during the remainder of the flight. If follows that a different approach is required.

Figure 2:
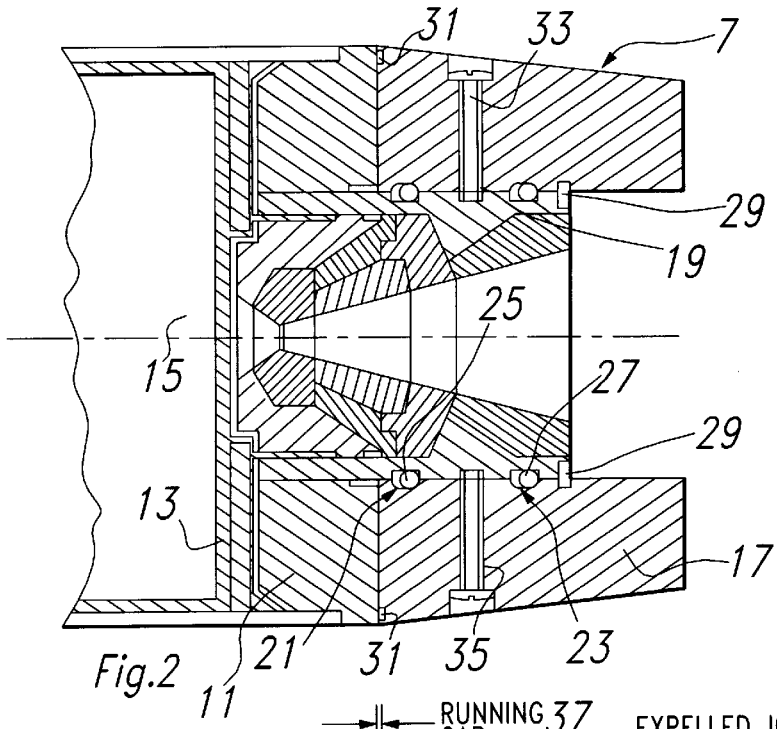
FIG. 2 is a cross sectional view of a tail fin assembly for the projectile of FIG. 1 in the locked position.
Figure 3:
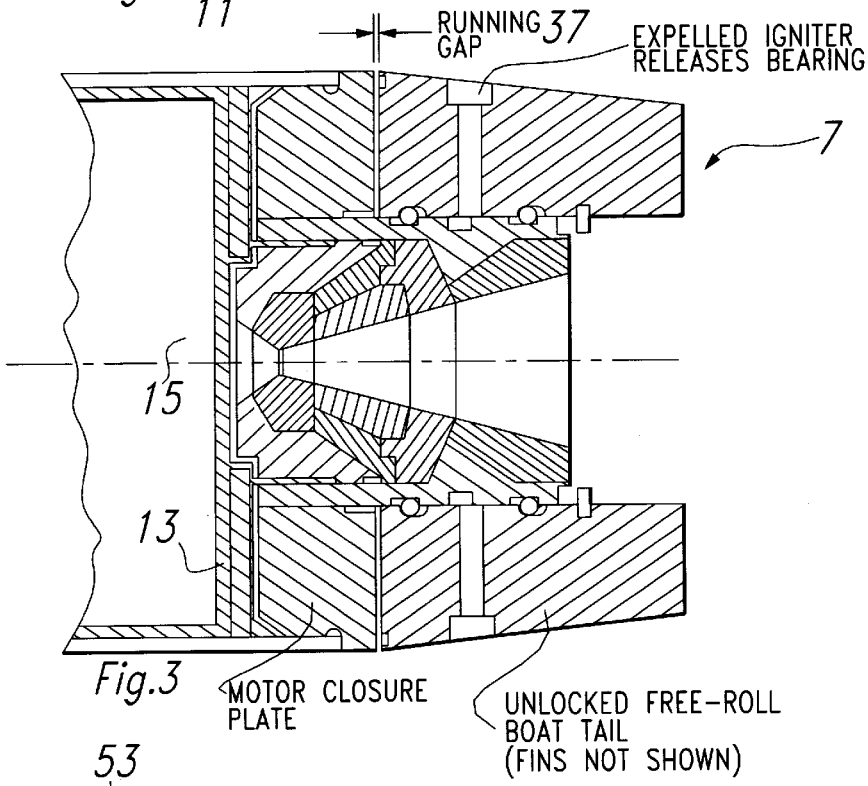
FIG. 3 is a cross sectional view of a tail fin assembly for the projectile of FIG. 1 in the unlocked position.
Figure 4:
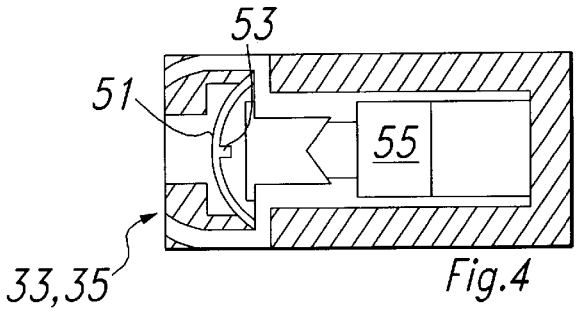
FIG. 4 is a cross sectional view of a typical igniter which can be used in accordance with the present invention.

Referring to FIG. 2, there is shown the tail section of the projectile in the locked position, this being the condition of the tail section prior to and immediately subsequent to ejection from the cannon or gun barrel. The tail section includes a motor closure plate 11 secured to the remainder of the projectile by way of an insulator wall 13 which, in part, encloses the propellant chamber 15. A locked free-roll boat tail 17 (fins 9 omitted) is disposed against the motor closure plate 11 and around a nozzle assembly 19, there being a pair of elongated races 21 and 23 disposed partly in the nozzle assembly and partly in the boat tail with ball bearings 25 and 27 disposed within the races. The races 21 and 23 are wider than the diameters of the ball bearings therein to allow eventual movement of the boat tail 17 relative to the nozzle assembly 19. A pair of seals, one such seal 29 provided between the boat tail 17 and the nozzle assembly 19 and one such seal 31 which is disposed between the motor closure plate 11 and the boat tail 17 prevent any gun gases from entering the races and damaging the ball bearings 25 and 27 when the projectile is initially ejected from the gun or cannon. The boat tail 17 is held in the locked position by a pair of igniters 33 and 35 which extend through the boat tail and into the nozzle assembly 19 to prevent movement of the boat tail along the major axis of the projectile. When the projectile 1 is ejected from the gun or cannon, the igniters 33 and 35 are armed to ignite a predetermined time after projectile ejection from the gun or cannon, generally about 2.5 seconds. The igniters 33 and 35 are well known mechanisms and, as shown in FIG. 4, include a dome portion 51 which is collapsed when the gun fires. The finger 53 in the dome then impinging against the delay train portion of the igniter 55. The igniters 33 and 35, which have been acting as a stop against lateral movement of the tail fin assembly 7 relative to the nozzle assembly 19 up to this time, explode outwardly after a delay which is determined by the delay train and clears the space in which the igniters have been positioned by ejecting the igniters out of the tail fin assembly 7. The drag on the tail fins 9 then drives the boat tail 17 rearwardly by the amount of play in the races 21 and 23 (the difference between the diameter of the ball bearing 25,27 and its associated race 21,23 respectively) as shown in FIG. 3 with the ball bearings 25 and 27 still disposed in the races 21 and 23. This rearward movement of the boat tail 17 establishes a running gap 37 between the motor closure plate 11 and the boat tail 7, with the boat tail now resting on the ball bearings 25 and 27, which is essentially the difference between the diameter of the ball bearings 25, 27 and their associated races 21, 23 respectively. The seals 29 and 31 are no longer in a position to create friction and, at this time, the tail fins 9 extend outwardly as shown in FIG. 1. The boat tail 17 is now free to rotate about the major axis of the projectile on the ball bearings 25 and 27 and remains in the unlocked state as shown in FIG. 3 due to the continued drag on the tail fins 9.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. An apparatus, comprising:

a projectile; an assembly supported on said projectile for rotation relative thereto about an axis approximately parallel to the direction of travel of said projectile, said assembly spinning freely with respect to said projectile in a rotating mode of operation; a plurality of fins supported on said assembly; and a locking structure cooperating with said projectile and said assembly, said locking structure preventing said assembly from freely rotating in a locking mode of operation and being responsive to a predetermined condition to switch from said locking mode to said rotating mode, and to permit said assembly to spin freely in said rotating mode of operation, wherein said locking structure includes:

said projectile having a radially extending cavity;

said assembly having a radially extending aperture aligned with said cavity; and a member disposed in said cavity and said aperture during said locking mode of operation, said member permitting said assembly to spin freely by ejecting from said cavity and said aperture in response to said predetermined condition, said predetermined condition being the elapse of a predetermined time interval after the launch of said projectile.

2. The apparatus of claim 1, wherein said member is an igniter that is activated by launch gases, said igniter producing an explosive force at the end of said predetermined time interval to effect the ejecting of said igniter from said cavity and said aperture.

3. An apparatus, comprising:

a projectile; an assembly supported on said projectile for rotation relative thereto about an axis approximately parallel to the direction of travel of said projectile, said assembly spinning freely with respect to said projectile in a rotating mode of operation; a plurality of fins supported on said assembly; and a locking structure cooperating with said projectile and said assembly, said locking structure preventing said assembly from freely rotating in a locking mode of operation and being responsive to a predetermined condition to switch from said locking mode to said rotating mode, and to permit said assembly to spin freely in said rotating mode of operation; wherein said assembly includes a first race, wherein said projectile includes a second race; including ball bearings disposed in said first race and said second race; wherein said assembly rotates relative to said projectile on said ball bearings; including a seal which assists in preventing launch gases from contacting said ball bearings; and wherein said assembly, in response to said locking structure permitting free spinning, moves relative to said projectile in a direction substantially parallel to the axis of rotation of said assembly from a first axial position to a second axial position, said axial movement disengaging said seal.

4. The apparatus of claim 3, wherein said first race and said second race each have a dimension in a direction parallel to the axis of rotation of said assembly that is greater than the diameter of said ball bearings, to thereby facilitate said axial movement of said assembly relative to said projectile.

5. An apparatus, comprising:

a projectile; an assembly supported on said projectile for rotation relative thereto about an axis approximately parallel to the direction of travel of said projectile, said assembly spinning freely with respect to said projectile in a rotating mode of operation; a plurality of fins supported on said assembly; a locking structure cooperating with said projectile and said assembly, said locking structure preventing said assembly from freely rotating in a locking mode of operation and being responsive to a predetermined condition to switch from said locking mode to said rotating mode, and to permit said assembly to spin freely in said rotating mode of operation; and a seal which assists in preventing launch gases from contacting at least a portion of said assembly in said locking mode of operation; wherein said assembly, in response to said locking structure permitting free spinning, moves relative to said projectile in a direction substantially parallel to the axis of rotation of said assembly from a first axial position to a second axial position, said axial movement disengaging said seal.

6. A method for minimizing roll of a projectile, comprising:

rotatably supporting a fin assembly, which includes a plurality of fins, on a projectile for rotation about an axis approximately parallel to the direction of travel of said projectile, said step of rotatably supporting said fin assembly including: providing a first race in said fin assembly; providing a second race in said projectile; providing ball bearings in said first race and said second race; and permitting said fin assembly to rotate relative to said projectile on said ball bearings;

permitting said fin assembly to spin freely relative to said projectile in a rotating mode of operation;

preventing said fin assembly from rotating in a locking mode of operation, said locking mode occurring before and during the launch of said projectile;

switching from said locking mode to said rotating mode after the launch of said projectile;

sealing said fin assembly with respect to said projectile during said locking mode so that launch gases do not contact said ball bearings;

preventing said fin assembly from moving relative to said projectile in a direction substantially parallel to the axis of rotation of said fin assembly in said locking mode; and permitting said fin assembly to move relative to said projectile at the start of said rotating mode, in a direction substantially parallel to the axis of rotation of said fin assembly, from a first axial position to a second axial position, said axial movement disengaging said sealing.

7. A method for minimizing roll of a projectile, comprising:

rotatably supporting a fin assembly, which includes a plurality of fins, on a projectile for rotation about an axis approximately parallel to the direction of travel of said projectile;

permitting said fin assembly to spin freely relative to said projectile in a rotating mode of operation;

preventing said fin assembly from moving relative to said projectile in a direction substantially parallel to the axis of rotation in a locking mode of operation;

sealing to prevent launch gases from contacting at least a portion of said fin assembly during said locking mode; and permitting said fin assembly to move relative to said projectile in a direction substantially parallel to the axis of rotation of said fin assembly from a first axial position to a second axial position in response to a predetermined condition, said axial movement disengaging said sealing.

8. An apparatus, comprising:

a projectile;

a member supported on said projectile for movement relative to said projectile; and a locking structure cooperable with said member and said projectile, said locking structure being operable to prevent said member from moving with respect to said projectile in a locked mode of operation which is effective prior to and during launch of said projectile, and being operable to permit said member to move relative to said projectile in an unlocked mode of operation which is effective after said locked mode, said locking structure including an igniter that is activated by launch gases during the launch of said projectile and that subsequently generates an explosive force which causes said locking structure to effect a switch from said locked mode of operation to said unlocked mode of operation.

9. An apparatus according to claim 8, wherein said locking structure includes said projectile and said member having respective openings therein which are aligned in said locked mode; wherein said igniter is disposed in said aligned openings in said locked mode; and wherein said explosive force effects physical movement of said igniter relative to said projectile and said member in a manner causing said igniter to move out of at least one of said openings.

10. An apparatus according to claim 8, wherein said explosive force occurs a predetermined time interval after said igniter is activated by launch gases.

11. An apparatus according to claim 8, wherein after said switch from said locked mode to said unlocked mode, said member can rotate relative to said projectile about an axis which extends approximately parallel to a direction of travel of said projectile.

12. An apparatus according to claim 11, wherein after said switch from said locked mode to said unlocked mode, said member can move axially with respect to said projectile.

13. An apparatus according to claim 12, including a bearing structure which supports said member for said rotational and axial movement with respect to said projectile; including a seal which is effective between said member and said projectile during said locked mode in a manner protecting said bearing structure from exposure to launch gases; and wherein after said switch from said locked mode to said unlocked mode, said member moves axially with respect to said projectile in a manner which effects disengagement of said seal.

14. An apparatus according to claim 11, including a plurality of fins which are supported on said member for movement between retracted and extended positions, said fins moving from said retracted position to said extended position after said switch from said locked mode to said unlocked mode, and wherein said member spins freely with respect to said projectile in said unlocked mode in response to aerodynamic forces exerted on said fins.

15. A method of operating a locking structure that can selectively implement locked and unlocked modes of operation in which the locking structure respectively prevents and permits movement relative to a projectile of a member movably supported on the projectile, comprising the steps of:

providing in the locking structure an igniter which is activated by launch gases during a launch of the projectile and which thereafter generates an explosive force;

maintaining the locking structure in the locked mode of operation prior to generation of the explosive force by the igniter; and causing the locking structure to effect a switch from the locked mode of operation to the unlocked mode of operation in response to generation by the igniter of the explosive force.

16. A method according to claim 15, wherein the member and the projectile have aligned openings which receive the igniter during the locked mode of operation; and wherein said step of causing the locking structure to effect a switch from the locked mode to the unlocked mode is carried out by effecting physical movement of the igniter in response to the explosive force in a manner causing the igniter to become disengaged from at least one of the openings.

17. A method according to claim 15, including the step of causing the igniter to generate the explosive force a predetermined time interval after the igniter is activated by launch gases.

18. A method according to claim 15, including the step of permitting the member to move both rotationally and axially with respect to the projectile after the switch from the locked mode operation to the unlocked mode of operation.

19. An apparatus comprising:

a projectile;

a member;

a bearing structure supporting said member on said projectile for relative rotational movement about an axis which extends approximately parallel to a direction of travel of said projectile, and for relative axial movement;

a locking structure operable to prevent said member from moving axially or rotationally with respect to said projectile in a locked mode of operation which is effective prior to and during a launch of said projectile, and operable to permit said member to move relative to said projectile in an unlocked mode of operation which is effective after said locked mode; and a seal structure operable in said locked mode of operation for effecting a seal between said member and said projectile which prevents launch gases from contacting said bearing structure, wherein when said locking structure effects a switch from said locked mode to said unlocked mode said member moves axially with respect to said projectile in a manner which effects disengagement of said seal.

20. An apparatus according to claim 19, wherein said seal structure includes two annular seal members, each said seal member being supported on one of said projectile and said member and sealingly engaging the other thereof during said locked mode of operation.

21. An apparatus according to claim 19, wherein said bearing structure includes first and second races which are respectively provided on said projectile and said member and which each have an annular groove therein, and a plurality of balls disposed between said races in engagement with said grooves, each said groove having an axial dimension which permits said balls to move axially therein so as to facilitate said axial movement of said member relative to said projectile.

22. An apparatus according to claim 19, including a plurality of fins which are provided on said member, said member spinning freely with respect to said projectile during said unlocked mode in response to aerodynamic forces exerted on said fins.

23. An apparatus according to claim 19, wherein said projectile and said member have respective axially facing bearing surfaces thereon which are respectively engaged and axially spaced in said locked and unlocked modes, engagement of said bearing surfaces protecting said bearing structure from physical forces generated during the launch of said projectile.

24. A method comprising the steps of:

providing a bearing structure which supports a member on a projectile for rotational and axial movement in relation to an axis that extends approximately parallel to a direction of travel of the projectile;

releasably locking the member against rotational and axial movement with respect to the projectile during a locked mode of operation which is effective prior to and during a launch of the projectile;

effecting a seal between the member and the projectile during the locked mode of operation in a manner which prevents launch gases from contacting the bearing structure;

thereafter switching from the locked mode to an unlocked mode in which the member is permitted to move rotationally and axially with respect to the projectile; and effecting axial movement of the member relative to the projectile at the beginning of the unlocked mode in a manner which disengages the seal between the member and the projectile.

* * * * *

UNITED STATES PATENT AND TRADEMARK OFFICE

CERTIFICATE OF CORRECTION

PATENT NO. : 6,126,109
DATED : October 3, 2000
INVENTOR(S) : Barson et al.

It is certified that error appears in the above-identified patent and that said Letters Patent is hereby corrected as shown below:

On the title page, item:

[56], Col. 2, line 8, FOREIGN PATENT DOCUMENTS, delete "1188951", and insert 1188651--.

Col. 5, line 11, after "race", delete ",", and insert --;--.

Signed and Sealed this

Eighth Day of May, 2001

*Attest:*

Nicholas P. Godici

NICHOLAS P. GODICI

*Attesting Officer*

*Acting Director of the United States Patent and Trademark Office*